United States Patent [19]

Davoud

[11] 3,990,243

[45] Nov. 9, 1976

[54] EXTERNAL COMBUSTION POWER PRODUCING CYCLE

[75] Inventor: John Gordon Davoud, Richmond, Va.

[73] Assignee: D-Cycle Associates, Richmond, Va.

[22] Filed: Jan. 8, 1975

[21] Appl. No.: 539,459

[52] U.S. Cl. ..... 60/653; 60/645; 60/679; 60/688

[51] Int. Cl.[2] ..... F01K 25/00

[58] Field of Search ..... 60/645, 649, 651, 653, 60/670, 671, 679, 688

[56] References Cited

UNITED STATES PATENTS

| | | | |
|---|---|---|---|
| 2,939,286 | 6/1960 | Pavlecka | 60/653 X |
| 3,329,575 | 7/1967 | Burbach et al. | 60/653 X |
| 3,772,883 | 11/1973 | Davoud et al. | 60/653 |

*Primary Examiner*—Allen M. Ostrager
*Attorney, Agent, or Firm*—Harold L. Stowell

[57] ABSTRACT

Steam or other condensable vapor heated to a maximum temperature at a maximum pressure permitted by the system is expanded to a lower pressure in a positive displacement expander; the partially expanded fluid is then further expanded in a turbine, a portion of the fluid in the turbine is withdrawn and directed to a positive displacement compressor and compressed to the maximum operating pressure while introducing the condensate of the remaining portion of the fluid into the compressor. The compressed fluid is then reheated to maximum temperature and the cycle repeats.

16 Claims, 6 Drawing Figures

EXTERNAL COMBUSTION POWER PRODUCING CYCLE

BACKGROUND OF THE INVENTION

My U.S. Pat. No. 3,716,990 teaches a method of improving the efficiency of steam or other condensing vapor cycles. In general the method is to use the work of expansion of a given weight of steam at a given high entropy, to compress in a positive displacement compressor a greater weight of steam at a lower entropy. The total weight of steam is then heated to maximum operating pressure and temperature. One portion of the steam is expanded in a reciprocating expander-compressor as above; and the remainder is used for further useful work, by expansion, for example, through a turbine.

The favored method for the expansion-compression part of the cycle is a steam-operated free piston expander-compressor.

As taught in the reference patent, the cycle has the characteristic that the expansion and compression stages of the positive displacement expander-compressor must be matched by expansion of some steam through a turbine thus:

1. The positive displacement expander-compressor cannot be operated above the maximum turbine inlet pressure in an existing steam plant; and
2. The theoretical advantage of using a positive displacement expander-compressor over a high pressure range is partially off-set by the relatively low efficiency of very high pressure turbines.

THE PRESENT INVENTION

The present invention is directed to an improved system wherein the inlet pressure of the expander of a positive displacement expander-compressor and the outlet pressure of the compressor (ideally the same) are higher than the maximum inlet pressure of a high pressure turbine.

The improved system permits increasing the output and efficiency of a power plant without increasing the existing turbine capacity and permits operation of the turbines at their optimum operating pressure range.

In general the invention may be defined as a power producing method, of the external combustion type, including heating a condensable vapor to a predetermined temperature at a predetermined pressure:

expanding the heated condensable vapor in a first work producing zone to a lower pressure;

reheating the expanded vapor;

expanding the reheated vapor to a lower pressure in a second work producing zone;

passing a portion of the expanded vapor to a work-demanding zone;

condensing the remainder of the expanded vapor;

adding the condensate or its weight equivalent to the vapor in the work-demanding zone;

utilizing the work produced in expanding the vapor in the first work-producing zone to compress to the original predetermined pressure the vapor passed to the work-demanding zone, plus the added condensate from the vapor expanded to the lower pressure; and by a power producing method, of the external combustion type, including heating a condensable vapor to a predetermined temperature at a predetermined pressure;

expanding the heated condensable vapor in a first work producing zone to lower pressure;

reheating the expanded vapor;

expanding the reheated vapor to a lower pressure in a second work producing zone, passing a portion of the expanded vapor to a work-demanding zone;

expanding the remaining portion to a still lower pressure;

condensing the expanded portion to liquid;

adding the condensate from the portion of the vapor expanded to the lower pressure, to the vapor in the work-demanding zone;

utilizing the work produced in expanding the vapor in the first work-producing zone to compress to the original predetermined pressure the vapor passed to the work-demanding zone, plus the added condensate from the vapor expanded to the lowest pressure.

The invention will be more particularly described in reference to the accompanying drawing wherein.

Figure 2:
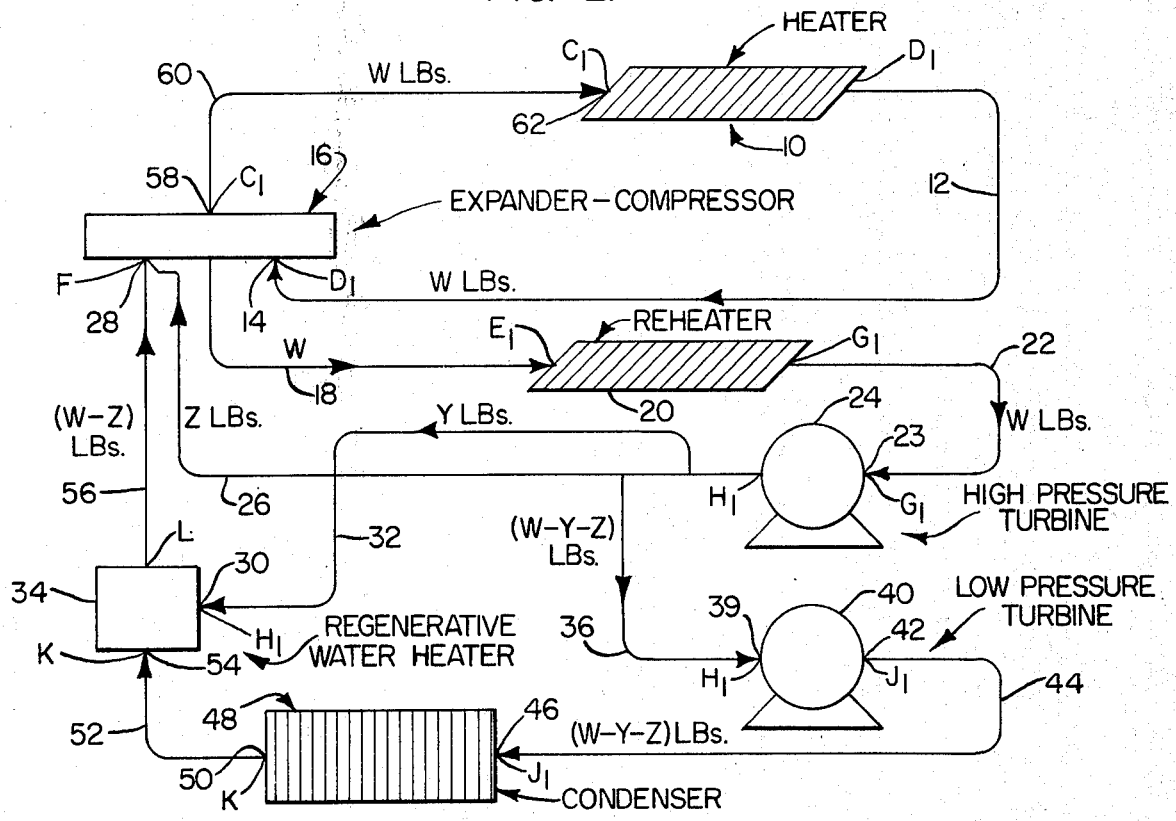
FIG. 2 is a diagrammatic showing of one form of power producing apparatus for carrying out the method shown in the phase diagram of FIG. 1.

Referring to FIG. 2 of the drawing, 10 generally designates an externally heated heater for a condensible working fluid such as steam. The heated steam at the desired temperature and pressure, leaves the heater via conduit 12 and enters the inlet port 14 of a positive displacement combined expander-compressor 16 as to be more fully described hereinafter. The steam entering the expander at 14, after expansion, exits through conduit 18 and is directed to an externally heated reheater 20.

The reheated vapor passes via line 22, from the reheater to the inlet 23 of a high pressure turbine 24. The expanded, working fluid exiting from the high pressure turbine 24 is divided into three parts: one part Z flows via conduit 26 to the inlet port 28 of the compressor portion of the expander-compressor 16; another portion Y flows to the inlet 30 via conduit 32 of a regenerative water heater generally designated 34; the third portion of the steam exiting from the high pressured turbine 24 flows via conduit 36 to the inlet port 38 of a low pressured turbine 40. In the illustrated form of the invention this portion of the steam is designated W–Y–Z pounds with Z pounds flowing to the compressor via line 26. Steam exiting from the low pressure turbine via outlet port 42 and conduit 44 is directed to the inlet 46 of the condenser 48.

The condensed working fluid exits via outlet 50 of the condenser 48 via conduit 52 to inlet 54 of the regenerative water heater 34. From the regenerative water heater 34 the heated liquid, comprising W+Z lbs., is directed via conduit 56 to inlet 28 of the compressor portion of the expander-compressor 16. The compressed fluid exits via outlet 58 and conduit 60 to the inlet 62 of the superheater 10 and the cycle repeats.

Figure 3:
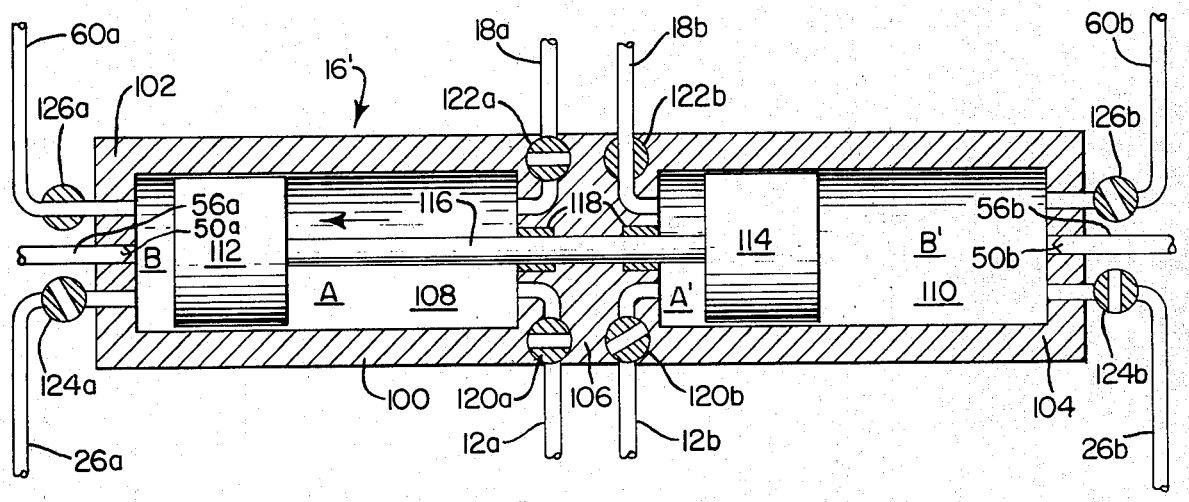
FIG. 3 illustrates a form of free-piston expander-compressor useful in carrying out the method of the present invention.

Referring now to FIG. 3 of the drawing, there is diagrammatically illustrated one form of the expander-compressor of the dual piston-cylinder type suitable for employment as expander-compressor 16 of FIG. 2 of the drawing. The free-piston type expander-compressor is generally designated 16' and includes a cyclinder wall 100 having cylinder heads 102 and 104 at opposite ends and a bulkhead 106 dividing the cylinder space into two equal zones designated 108 and 110. Cylinder space 108 receives a piston 112 while cylinder space 110 receives a piston 114. The pistons 112 and 114 are interconnected by a piston rod 116 which passes through a bore in the bulkhead provided with suitable seals such as shown at 118.

Each cylinder space 108 and 110 is provided with an expansion zone designated A and A' and a compression zone designated B and B' respectively. High temperature, high pressure steam is directed into expansion chambers A and A' via conduits 12*a* and 12*b* which correspond to conduit 12, FIG. 2 of the drawing. Each of the conduits 12*a* and 12*b* is provided with a control valve 120*a* and 120*b* mechanically connected to the expander-compressor by mechanisms, not shown, and connected such that the high temperature steam is directed to one cylinder zone and then to the other. Expanded steam exhausts from the cylinder spaces A and A' via conduit 18*a* or 18*b* which correspond to conduit 18, FIG. 2 of the drawing. Each of the conduits 18*a* and 18*b* is provided with a flow control valve 122*a* and 122*b* which are also cyclicly opened and closed like valves 120*a* and 120*b*. The conduits 18*a* and 18*b* direct the partially expanded steam to the reheater 20 of FIG. 2 of the drawing.

Conduits 26*a* and 26*b* direct expanded steam from the high-pressure turbine 24 to the cylinder spaces B and B' respectively via flow control valves 124*a* and 124*b* which are also mechanically connected to the reciprocating expander-compressor or independently timed and driven. Compressed steam plus water is directed from cylinder spaces B and B' via conduit 60*a* or 60*b* to the superheater 10, FIG. 2 of the drawing. Each of the conduits 60*a* and 60*b* is provided with flow control valves 126*a* and 126*b* which are actuated like flow control valves 124*a* and 124*b*.

Cylinder spaces B and B' are also provided with injectors 50*a* and 50*b* for water which inject pressurized water into the respective chambers and the conduits for these injectors are designated 56*a* and 56*b* and correspond to conduit 56, FIG. 2 of the drawing. The injector conduits 56*a* and 56*b* may be provided with one-way valves to prevent reverse flow during the end portion of the compression cycle.

Figure 4:
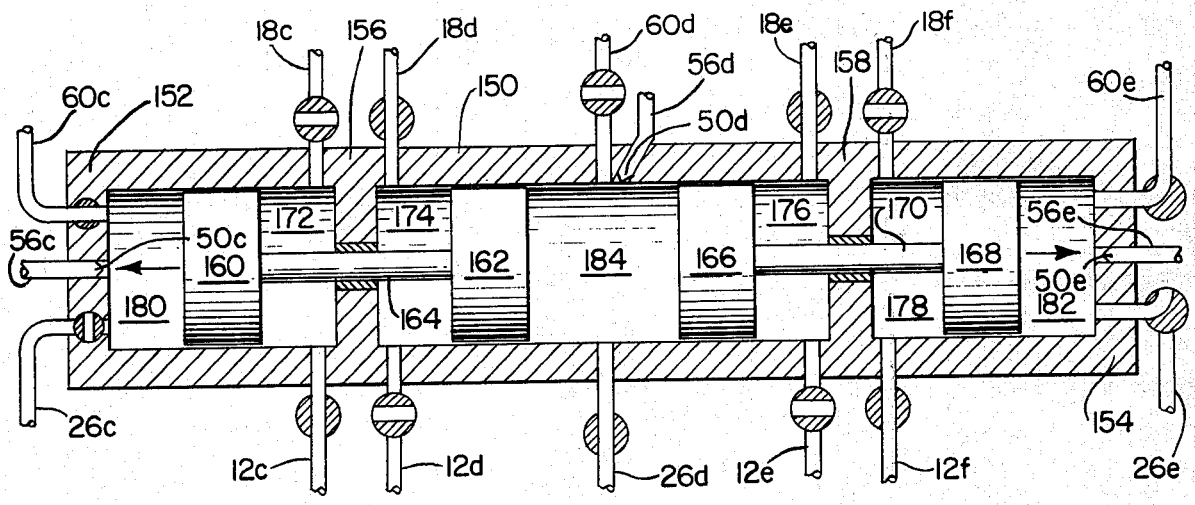
FIG. 4 is a view like FIG. 3 of a free-piston expander-compressor with balanced forces.

It would be recognized by those skilled in the art that the form of the compressor-expander illustrated in FIG. 3, having only the pair of pistons 112 and 114 interconnected by connecting rod 116, would in operation have out of balance forces along the principle axis of the expander-compressor. A simple and practical solution to the out of balance forces is provided by joining two expander-compressors together as illustrated in FIG. 4. In FIG. 4 the cylinder 150 is provided with heads 152 and 154 and a pair of internal bulkheads 156 and 158. The cylinder 150 receives pistons 160 and 162 which are interconnected by connecting rod 164 and pistons 166 and 168 which are interconnected by connecting rod 170. It will be seen therefore that there are four expansion chambers 172, 174, 176 and 178; two end compression chambers 180 and 182 and one central compression chamber 184 having a volume twice as large as either compression chamber 180 or 182.

The expansion and compression chambers are connected with valved conduits like the valved conduits shown in FIG. 3 and designated with the same reference characters preceded by letters *c, d, e,* etc., as the case may be, with the opposite ends of the conduits connected to the heater, the reheater, the high pressure turbine, the low pressure turbine and the regenerative water heater as shown in FIG. 2 and described in reference to FIG. 3.

Figure 6:
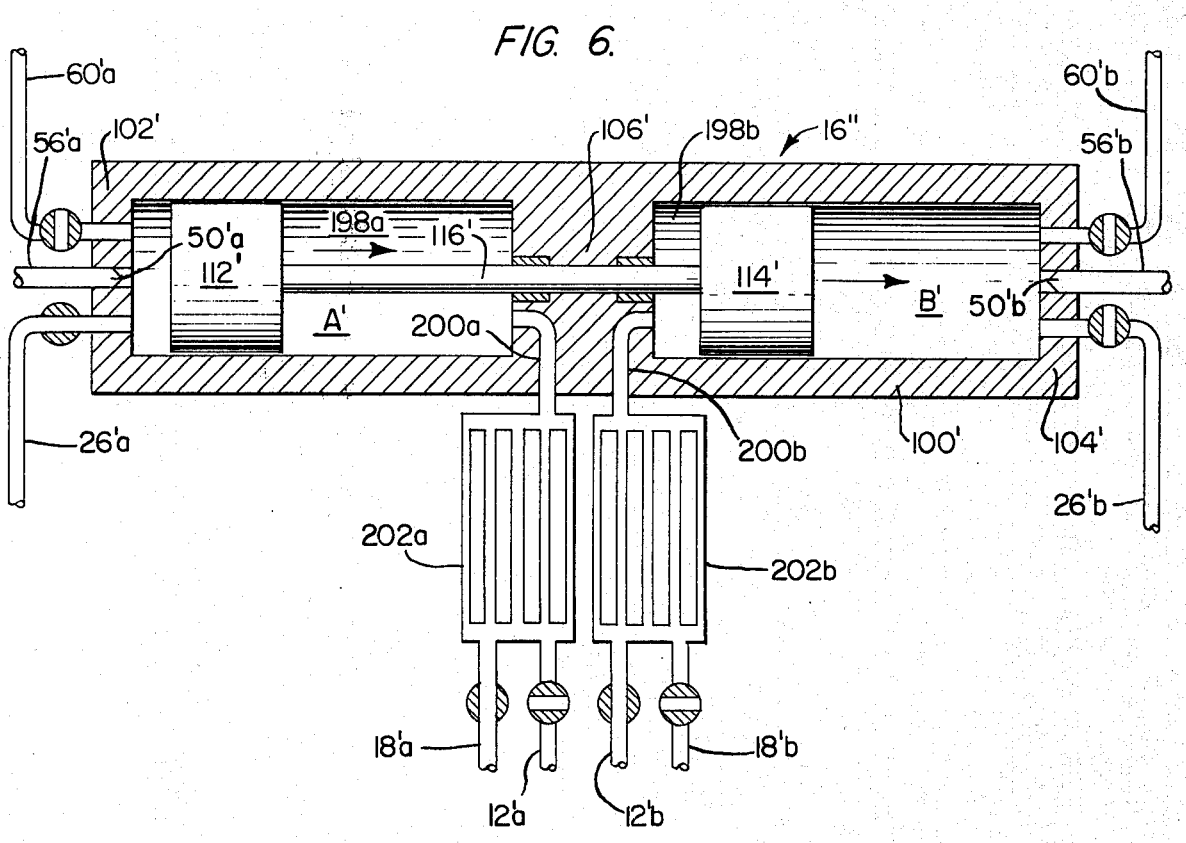
FIG. 6 is a view like that shown in FIG. 3 including means for adding heat to the vapor during vapor expansion.

The present invention also includes as one of its embodiments a method of incorporating into the cylinder of the expander a heat-transfer system with a large surface-volume ratio as part of the clearance volume of the cylinder. This volume can be conveniently in the form of a tube bundle which is heated continuously as is the cylinder. A suitable free-piston expander-compressor of this type, with heat input during expansion is illustrated in FIG. 6. The expander generally designated 16'' includes a cylinder 100'. Opposite ends of the cylinder are closed by cylinder heads 102' and 104' and the cylinder includes an interior bulkhead 106' dividing the cylinder into two cylinder spaces A', B' within which pistons 112' and 114' reciprocate. The pistons are interconnected by piston rod 116'.

Through cylinder head 102' extend conduits 26'*a*, 60'*a* and 56'*a* connected as described in reference to FIG. 3 and containing suitable control valves as previously described. The opposite head 104' has projecting there through complimentary conduits 26'*b*, 60'*b* and 56'*n*. A conduit 200*a* connected to a tubular type heater 202*a* is connected to the expansion zone 198*a* of cylinder space A' while a similar conduit 200*b* having one end connected to the tubular type heat imput device 202*b* leads into the expansion zone 198*b* of cylinder space B'.

Valved inlets 12'*a* and 12'*b* direct high pressure steam from heater 10 into the reheaters 202*a* and 202*b* while valve conduits 18'*a* and 18'*b* direct expanded steam from the zones 198*a* and 198*b* respectively to the reheater 20, FIG. 2 of the drawing. Therefore conduits 12*a*, 12*b*, 18*a* and 18*b* correspond to conduits 12*a*, 12*b*, 18*a* and 18*b* of FIG. 3 of the drawing, with all of the conduits of FIG. 6 being interconnected to the mechanisms illustrated in FIG. 2 as discussed with reference to FIG. 3 of the drawing.

The invention will be further described in reference to the following examples:

EXAMPLE 1

Figure 1:
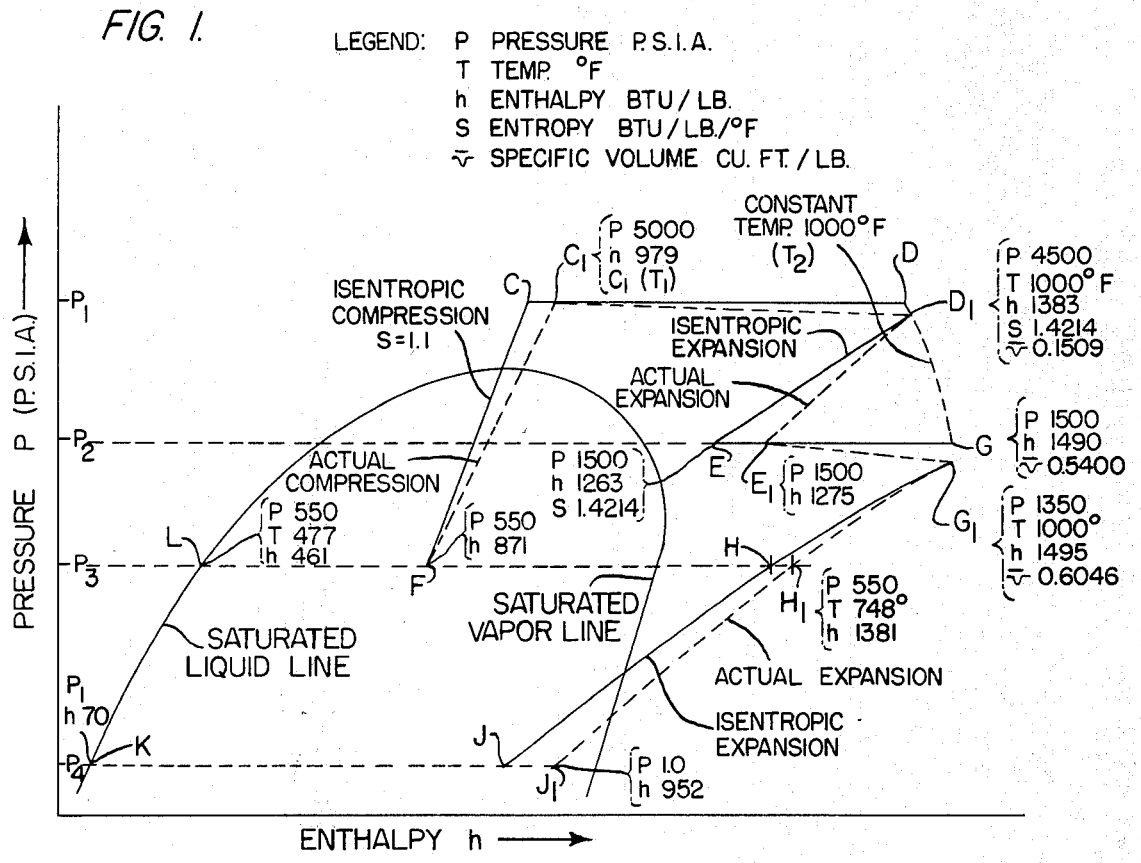
FIG. 1 is a pressure-enthalpy phase diagram showing state-points for an application of the system of the invention.

The apparatus shown in FIG. 2 may be operated with the state-points shown in FIG. 1 and the steps of the cycle are:

$C_1$–$D_1$ heat steam (*w* lbs.) at pressure $P_1$ psia at inlet of heater 10, and temperature T ° F to maximum operating temperature $T_2$. Allow 10% drop in heater pressure.

$D_1$–$E_1$—admit *w* lbs. steam at state point $D_1$ into positive displacement expander 16. Expand to $E_1$. $D_1E_1$ represents a 90% efficient expansion, defined herein as an expansion in which the useful work obtained is 90% of the ideal isentropic work between the same pressure limits. In FIG. 1, the horizontal projection of $D_1E_1 = 0.9$ × horizontal projection of $D_1E$; put another way, $(h_{D_1} - h_{E_1}) = 0.9 \times (h_{D_1} - h_E)$.

$E_1$— Remove all expanded steam w lbs. from positive displacement expander at pressure $P_2$ psia.

Reheat in reheater 20 to maximum operating temperature, $T_2$. Allow 10% drop in the reheater.

Pass all steam from reheater (*w* lbs.) to high pressure turbine, 24.

$G_1$–H Expand through high pressure turbine from $P_2$ to $P_3$.

$H_1$ Remove all steam (*w* lbs.) from high pressure turbine. Separate Y lbs. for 1-stage regenerative water heater 34.

Separate Z lbs. of steam. Pass to inlet of compressor side of positive displacement expander-compressor 16 at pressure $P_3$.

Pass remainder (W–Y–Z lbs.) to low pressure turbine 40.

$H_1$–$J_1$— Expand W–Y–Z lbs. of steam in low pressure turbine from $P_3$ to $P_4$.

$J_1$ K — Remove W–Y–Z lbs. steam from low pressure turbine. Pass to condenser 48; condense at pressure $P_4$ to water at K.

K–L — Pass Y lbs. of steam, at state-point $H_1$, and (W–Y–Z) lbs. of water, state point X, to regenerative feedwater heater 34, producing (W–Z) lbs. pressurized water, at pressure $P_3$, state point L.

Into intake of compressor of expander-compressor 16 admit Z lbs. steam, of state-point $H_1$.

Inject during intake and compression W–Z lbs. of water, state point L, producing wet steam, at pressure $P_3$, at point F.

F–$C_1$ — Compress to maximum operating pressure $P_1$.

F C represents ideal isentropic compression. The work of compression is given by the horizontal projection of F C or by $(h_c$–$H_F)$.

The horizontal projection F $C_1$ is 1.10 × F C. i.e. $(h_{C_1} - h_F) = 1.10 \times (h_C - h_F)$ These conventions for expansion and compression are described herein as 90% expansion and compression efficiencies.

EXAMPLE II

A numerical example of the cycle as described in Example 1, comprises:

Vapor Compression Cycle

Illustrates use of steam operated free piston expander-compressor with outlet pressure from expander greater than maximum turbine inlet pressure.

The numerical values of the state-points used in this example are shown in FIG. 1.

1. In positive displacement expander 16, expand 1 lb. of steam from $D_1$ to $E_1$, from 4500 to 1500 psia Work of expansion = (1383 − 1275) = 108 B.T.U.
2. Remove 1 lb. of steam from expander. Pass to reheater 20. Reheat to 1000°; at 1350 psia. ($G_1$). Heat in reheater = (1495 − 1275) = 220 B.T.U.
3. Pass 1 lb. steam at $G_1$ to turbine 24. Expand to $H_1$ (P = 550 psia, *h* = 1381 B.T.U. lb.) Turbine work out is 1495 − 1381 = 114 B.T.U.
4. Remove 1 lb. steam, from turbine 24. Pass 0.446 lbs. to intake of positive displacement compressor, 16.
5. Pass 0.165 lbs. steam at state point $H_1$, to regenerative heater 34.

6. Pass 0.389 lbs. steam, having state point $H_1$ to turbine, 40. Expand in turbine to $J_1$ (1 psia, *h* = 952 B.T.U./lb.). Turbine Work out is 0.389 × (1381 − 952) = 167 B.T.U.
7. Condense 0.389 lbs. steam at $J_1$ to water at K.
8. Mix 0.389 lbs. water at K with 0.136 lbs. of steam at $H_1$ in regenerative feed-water heater 34. Resultant water (0.418 + 0.136) = 0.554 lbs. at state-point L, 550 psia, h 461 B.T.U./lb.
9. Take into positive displacement compressor 0.446 lbs. steam, state-point $H_1$. Inject into cylinder during intake of steam into compressor 0.554 lbs. water, state-point L. Resultant steam has state-point F (p 550 psia h 871, entropy *s* = 1.1
10. Compress 1 lb. steam from F to $C_1$. Work of compression is 979 − 871 = 108 B.T.U.
11. Heat 1 lb. steam from $C_1$ to $D_1$
    Heat in is 1383 − 979 = 404 B.T.U.

Cycle Repeats.

Turbine work out = 114 + 167 = 281 B.T.U.

Total heat in = 220 + 404 = 624 B.T.U.

$$\text{Efficiency } \eta = \frac{281}{624} = 0.450$$

In expander-compressor, conditions shown result in equal work of expansion and compression of 1 lb. of steam.

Work of expansion from 4500 to 1500 psi = 108 B.T.U.

Work of compression from 550 to 5000 psia = 108 B.T.U.

For comparison, the Rankine cycle, using the same turbine staging, and 1 stage of regeneration to the same pressure as Example II has efficiency $\eta_{Rankine} = 0.401$ A further improvement in the thermal efficiency of the vapor-compression cycle can be effected by supplying heat to the working fluid in the expansion chambers of the expander-compressor. This has the effect of increasing the ratio of work of expansion to work of compression. Ideally, a large increase in the work of expansion of a gaseous working substance compared with isentropic expansion, between given pressure limits, is given by isothermal expansion, in which the temperature of the expanding fluid remains constant. In practice, it is probably impossible to achieve isothermal expansion; the best that can be looked for is to achieve something between isothermal and isentropic.

In the vapor compression cycle, even the gain in work of expansion resulting from a partial (and practicable) measure of heat input in the expansion stage, is significant, and can effect disproportionate improvement in overall cycle thermal efficiency.

The following example is of a cycle with partial isothermal expansion in an expander-compressor, and means of carrying out such a cycle. True Isothermal expansion amounts to expansion with an infinite number of re-heat stages. The locus of the state-point of the fluid during expansion is the line of constant temperature between the pressure limits of the expansion; in FIG. 1, e.g., it is the line $D_1$–G; and the steam at the end of expansion would be at state-point G.

$T_R$ is the absolute temperature

T is 1000° F in FIG. 1, hence, $T_R$ is 1460;

$P_1$ is 4500 psia; $P_2$ is 1500 psia and the isothermal work out is $$\frac{86 \times 1460}{778} \times 2.302 \times \log_{10} \frac{4500}{1500} = 177 \text{ B.T.U.}$$

In a positive displacement expander, e.g., in a piston and cylinder type expander, a way such an expansion could be approximated would be to heat the cylinder externally, and carry out the expansion slowly enough to approach the ideal reversible situation as taught in textbooks on the thermodynamics of the Stirling and Ericsson cycles, both of which are based on ideal isothermal expansion.

In practice this is probably impossible; the surface-volume ratio of a practical size of cylinder-piston is too small, and the relatively poor heat transfer on the outside surface of the cylinder, imposes further limitations.

The present invention includes a method of incorporating into the piston-cylinder of the expander a heat-transfer system with a large surface-volume ratio as part of the clearance volume of the piston and cylinder. This volume, as shown in FIG. 6, can conveniently be in the form of a tube bundle, which is heated continuously. The cylinder is also heated. The calculations which follow, under Example II, are based on the following:

i. The steam in the heated clearance volume undergoes isothermal expansion as the swept volume increases.

ii. The continuous flow of heated steam from the heated clearance volume into the cylinder during expansion will in effect result in isentropic expansion of the steam in the cylinder.

The block-diagram of the system to carry out the cycle can also be represented by FIG. 2. However, the free piston expander-compressor is different, as shown diagrammatically in FIG. 6. The out-of-balance forces along the principal axis of motion of a device such as depicted in FIG. 6 could be balanced by doubling its length and using two piston sets, in a way analogous to that shown in FIG. 4.

Figure 5:
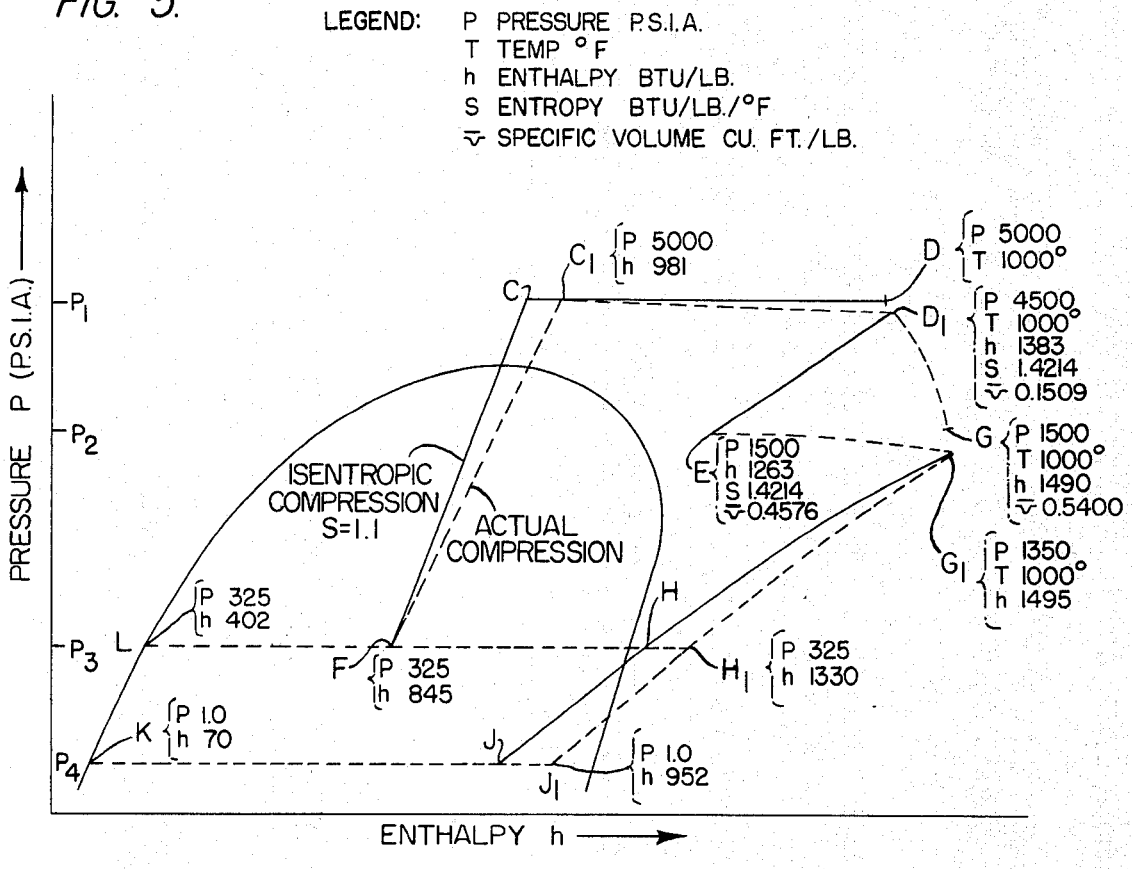
FIG. 5 is phase diagram showing state-points for another application of the system of the invention.

A numerical example of a cycle of this kind described is given as Example III. The numerical values of the state points are shown in FIG. 5.

EXAMPLE III

Vapor Compression Cycle

Illustrates use of steam operated free piston expander with heat addition in expansion. The exhaust pressure of the expander is greater than the pressure at the high-pressure turbine inlet.

1. With piston 112' at top dead center, admit 1 lb. of steam, at $D_1$ into clearance volume (tube bundle 202*a*).

2. Expand to 1500 psia. At end of expansion, the steam in the tube bundle will be at G; the steam in the cylinder will be at E. Weight of steam in the tube bundle is $$\frac{\overline{v}D_1}{\overline{v}_G} = \frac{0.1509}{0.5400} = 0.2795 \text{ lbs.}$$

Isothermal work from expansion of 0.2795 lbs. of steam at 1000° from 4500 to 1500 psia is $$0.2795 \times \frac{86 \times 1460}{778} \times 2.302 \log_{10} \times \frac{4500}{1500} = 49.5 \text{ B.T.U.}$$

Heat input into tube bundle is:

$$(\text{Isothermal work out} + 0.2795 \times (h_G - h_{D1}) = 49.5 + 0.2795 \times (1490 - 1383) = 79.4 \text{ B.T.U.}$$

The remaining steam (1.00 − 0.2795) = 0.7205 lbs. expanding isentropically to E will produce $$0.7205 \times (h_{D1} - h_E) = 0.7205 \times (1383 - 1263) = 86.5 \text{ B.T.U.}$$

The total expansive work from 1 lb. of steam is 49.5 + 86.5 = 136 B.T.U.

The heat input during expansion is 79.4 B.T.U.

3. Pass expanded steam to reheater 20 of FIG. 2. At the end of expansion, in expansion chamber plus clearance volume, is 0.2795 lbs. steam at G ($h_G = 1490$)

0.7205 lbs. steam at E ($h_E = 1263$)

Enthalpy of resultant steam after mixing is 1327 BTU/lb. In reheater 20 of FIG. 2 heat all steam to $G_1$.

$$\text{Heat required } 1.0 \times (h_{G_1} - 1327) = 1495 - 1327 = 168 \text{ B.T.U.}$$

4. Pass all steam from reheater 20 to high pressure turbine 24, FIG. 2. Expand to 325 psia. ($H_1$ in FIG. 5). Remove all steam from turbine 24. Work out from high pressure turbine is $h_{G_1} - h_{H_1} = 1495 - 1330 = 165$ B.T.U.

5. Pass 0.479 lbs. of steam, state-point $H_1$, to intake of compressor of expander-compressor 16'', FIG. 6.

6. Pass 0.1377 lbs. of steam, state-point $H_1$, to regenerative water heater 34, FIG. 2.

7. Pass 0.3833 lbs. steam, state-point $H_1$ to low pressure turbine 40, FIG. 2. Expand to 1 psia ($J_1$ FIG. 5). Work out from low pressure turbine is $$0.3833 \times (h_{H_1} - h_{J_1}) = 0.3833 \times (1330 - 952) = 145 \text{ B.T.U.}$$

8. Condense steam at $J_1$ to water at K.

9. Mix 0.3833 lbs. water state-point K with 0.1377 lbs. of steam, state point $H_1$, in regenerative water heater 34. Resultant water (0.3833 + 0.1377) = 0.521 lbs. at state-point L, P = 325 psia; $h$ = 402 B.T.U.

10. Take into positive displacement compressor of expander-compressor 16'', of FIG. 6, via inlet 26'*a* or 26'*b* of FIG. 6, 0.479 lbs. of steam, state-point $H_1$, FIG. 5.

Inject into one of the cylinder compression chambers of FIG. 6 during intake stroke of compressor, through conduit 56'*a* or 56'*b*, and injector 50'*a* or 50'*b*, 0.521 lbs. water, state-point $H_1$. Resultant steam has state-point F; P = 325; $h$-845 Total wt. 1.0 lbs.

11. Compress 1 lb. of steam from F to $C_1$ FIG. 5. Work of compression is $$h_{C_1} - h_F = 981 - 845 = 136 \text{ B.T.U.}$$

12. Pass 1 lb. steam, state-point $H_1$, FIG. 5, to heater 10, FIG. 2. Heat to $D_1$ ($p$-4500, $h$-1383)

Heat required in heater = ($h_{D_1} - h_{C_1}$) = 402 B.T.U.

Cycle repeats.

Turbine work out is 165 + 145 = 310 B.T.U./lb. of steam through heater.

Heat required is 402 + 168 + 80 = 650 B.T.U./lb of steam through heater.

$$\text{Efficiency } \eta = \frac{310}{650} = 0.477$$

In expander-compressor, conditions shown result in equal work of expansion and compression of 1 lb. of steam.

Work of expansion from 4500 to 1500 psia = 136 B.T.U.

Work of compression from 325 to 5000 psia = 136 B.T.U.

For comparison, the Rankine cycle, using the same turbine staging, and one stage of regeneration, from 1 psia to 325 psia (as in Example III) has efficiency $\eta_{Rankine} = 0.405$

I claim:

1. A power producing method, of the external combustion type, the method including heating a condensable vapor to a predetermined temperature at a predetermined pressure:

a. expanding the heated condensable vapor in a first work producing zone to a lower pressure;
b. reheating the vapor expanded in step (a);
c. expanding the reheated vapor to a lower pressure;
d. passing a portion of the vapor expanded in step (c) to a work-demanding zone;
e. condensing the remainder of the vapor expanded in step (c) at the lower pressure;
f. adding the condensate formed in step (e) or its weight equivalent to the vapor in the work-demanding zone of step (d);
g. utilizing the work produced in expanding the vapor in the first work-producing zone, step (a), to compress the vapor passed to the work-demanding zone, step (d), plus the added condensate, from step (e), from the vapor expanded to the lower pressure, to compress the vapor plus liquid to the original predetermined pressure.

2. A power producing method, of the external combustion type, the method including heating a condensable vapor to a predetermined temperature at a predetermined pressure;

a. expanding the heated condensable vapor in a first work producing zone to a lower pressure;
b. reheating the vapor expanded in step (a);
c. expanding in a second work producing zone the vapor reheated in step (b) to a lower pressure;
d. passing a portion of the vapor expanded in step (c) to a work-demanding zone;
e. further expanding in a third work producing zone the remaining portion of the vapor expanded in step (c) to a still lower pressure;
f. condensing the vapor expanded in step (e) to liquid;
g. adding the condensate from step (f) to the vapor in the work-demanding zone of step (d);
h. utilizing the work produced in expanding the vapor in the first work-producing zone, step (a), to compress the vapor passed to the work-demanding zone, step (d), plus the added condensate from step (f) to compress the vapor plus liquid to the original predetermined pressure.

3. The method defined in claim 1 where the work of expansion of vapor in the first work-producing zone, step (a), from a given predetermined pressure to a lower pressure is equal to the work required to compress the same weight of vapor and liquid to the original predetermined pressure, from a pressure lower than the pressure of vapor expanded in step (a).

4. The method defined in claim 1 where the first work-producing zone is an expansive chamber in a positive displacement device, and the work-demanding zone is the swept volume of positive displacement device.

5. The method defined in claim 4 where the expansive chamber of the first work producing zone, step (a), is heated externally during the expansion.

6. The method defined in claim 4 where an externally heated volume is incorporated into the work-producing zone, step (d), in the form of a clearance volume in a positive displacement expander.

7. The method defined in claim 5 where an externally heated volume is incorporated into the work-producing zone, step (d), in the form of a clearance volume in a positive displacement expander.

8. The method defined in claim 6 where the heated zone is in the form of a tube bundle.

9. The method defined in claim 5 where the heat is applied to the working substance during expansion by direct heating of the heated clearance volume by gaseous products of combustion.

10. The method defined in claim 6 where the heat is applied to the working substance during expansion by direct heating of the heated clearance volume by gaseous products of combustion.

11. The method defined in claim 7 where the heat is applied to the working substance during expansion by direct heating of the heated clearance volume by gaseous products of combustion.

12. The method defined in claim 5, where the heat is applied to the working substance by liquid or condensing vapor from a condensable vapor heat transfer fluid.

13. The method defined in claim 6, where the heat is applied to the working substance by liquid or condensing vapor from a condensable vapor heat transfer fluid.

14. The method defined in claim 7, where the heat is applied to the working substance by liquid or condensing vapor from a condensable vapor heat transfer fluid.

15. The method defined in claim 1 where the work producing zone, step (a), and work-demanding zones, steps (d) and (g), comprise a pair of cylinders and a pair of pistons, rigidly connected, forming a free-piston expander and compressor.

16. The method defined in claim 2 where the work producing zone, step (a), and work-demanding zones, steps (d) and (h), comprise a pair of cylinders and a pair of pistons, rigidly connected, forming a free-piston expander and compressor.

* * * * *